US009790717B2

(12) United States Patent
Patterson

(10) Patent No.: US 9,790,717 B2
(45) Date of Patent: Oct. 17, 2017

(54) DOOR SECURITY REINFORCEMENT SYSTEM

(71) Applicant: Kenneth S. Patterson, Gilbert, AZ (US)

(72) Inventor: Kenneth S. Patterson, Gilbert, AZ (US)

( * ) Notice: Subject to any disclaimer, the term of this patent is extended or adjusted under 35 U.S.C. 154(b) by 386 days.

(21) Appl. No.: 14/448,475

(22) Filed: Jul. 31, 2014

(65) Prior Publication Data

US 2016/0032631 A1 Feb. 4, 2016

(51) Int. Cl.

| | |
|---|---|
| ***E05C 9/10*** | (2006.01) |
| ***E05C 9/04*** | (2006.01) |
| ***E05B 63/00*** | (2006.01) |
| ***E05C 7/00*** | (2006.01) |
| ***E05C 9/18*** | (2006.01) |
| ***E05B 13/00*** | (2006.01) |
| ***E05C 9/02*** | (2006.01) |
| *E05C 9/00* | (2006.01) |
| *E05C 7/06* | (2006.01) |
| *E05C 9/24* | (2006.01) |

(Continued)

(52) U.S. Cl.

CPC ..... *E05C 9/048* (2013.01); *E05B 13/002* (2013.01); *E05B 63/0004* (2013.01); *E05B 63/0052* (2013.01); *E05C 7/00* (2013.01); *E05C 9/028* (2013.01); *E05C 9/043* (2013.01); *E05C 9/1875* (2013.01); *E05C 7/06* (2013.01); *E05C 9/063* (2013.01); *E05C 9/24* (2013.01); *E05C 19/003* (2013.01); *Y10S 292/15* (2013.01)

(58) Field of Classification Search

CPC . E05C 9/24; E05C 9/063; E05C 19/00; E05C 19/003; E05C 19/005; E05C 7/00; E05C 7/06; E05B 17/2084; Y10S 292/15; Y10S 292/63; Y10S 292/68

USPC ..... 292/38, 44, 45, 49, 50, 125, 133, 225, 292/235, 259 R; 49/394, 395

See application file for complete search history.

(56) References Cited

U.S. PATENT DOCUMENTS 398,608 A * 2/1889 Hall ..... E05B 15/10 109/74
485,661 A * 11/1892 Royer ..... E05C 19/18 292/288

(Continued)

FOREIGN PATENT DOCUMENTS

DE 2425092 A1 * 12/1975 ..... E05C 9/1883
FR EP 2305931 A1 * 4/2011 ..... E05B 63/0004
IN WO 2004101364 A2 * 11/2004 ..... E05C 9/1875

*Primary Examiner* — Carlos Lugo

(74) *Attorney, Agent, or Firm* — Panitch Schwarze Belisario & Nadel LLP

(57) ABSTRACT

A security reinforcement system for a door assembly having a door frame with first and second spaced-apart vertical structural supports and a door hinged thereto has first- and second-channel base plates respectively mountable to the first and second vertical structural support. Pivotally attached to the first and second base plates, respectively, are first and second opposed pluralities of security arms which rotate from a retracted position to an extended position in which security arms of the opposed pluralities extend toward each other across a portion of the door, reinforcing the door when first and second actuator arms operatively coupled to the first and second pluralities, respectively, are rotated from a vertical position to a horizontal position and are releasably coupled together by a sleeve.

13 Claims, 10 Drawing Sheets

(51) Int. Cl.
*E05C 19/00* (2006.01)
*E05C 9/06* (2006.01)

(56) References Cited

U.S. PATENT DOCUMENTS 581,778 A * 5/1897 Severio ..... E05B 65/0007 292/192
838,437 A * 12/1906 McDaniel ..... A47K 5/02 211/149
1,529,085 A * 3/1925 Preble ..... E05C 9/02 292/138
1,693,481 A 11/1928 Harper
1,774,783 A * 9/1930 Worley, Jr. ..... E05B 65/025 292/48
2,151,587 A * 3/1939 Cassileth ..... E05C 19/18 292/288
2,153,088 A * 4/1939 Knell ..... E05B 47/0607 109/59 R
2,339,073 A * 1/1944 Hobson ..... E05C 7/06 292/102
2,580,584 A * 1/1952 Nowak ..... E05B 65/0021 292/26
2,729,089 A * 1/1956 Pelcin ..... E05B 47/0002 292/36
2,753,020 A * 7/1956 Ware, Jr. ..... E06B 7/18 292/48
2,879,725 A 3/1959 Zuver
3,613,312 A 10/1971 Wolak et al.
4,003,227 A * 1/1977 Casey ..... E05B 13/002 292/258
4,046,410 A 9/1977 Connell
4,199,176 A * 4/1980 Kelly ..... E05C 9/063 292/141
4,435,921 A * 3/1984 Marin ..... E05B 63/242 16/388
4,999,949 A 3/1991 Granlund
5,072,978 A * 12/1991 Woodward ..... E05B 13/004 292/359
5,096,238 A * 3/1992 Mintz ..... E05C 9/02 292/35
6,018,968 A * 2/2000 Sides ..... E05B 67/36 292/288
6,101,764 A 8/2000 Guy-Paul
6,601,884 B2 * 8/2003 Bastian ..... E05C 3/165 292/182
6,675,536 B1 1/2004 Williams et al.
6,684,570 B1 * 2/2004 Robledo ..... E05B 65/0035 292/145
6,802,543 B1 * 10/2004 Wakefield ..... E05B 13/002 292/11
6,938,376 B2 * 9/2005 Youssef ..... B64C 1/1469 114/201 R
7,040,675 B1 * 5/2006 Ott ..... B60J 7/19 292/123
7,261,328 B2 * 8/2007 Minix ..... E05B 13/10 292/28
7,343,762 B1 * 3/2008 East ..... E05B 13/108 292/36
7,387,076 B2 6/2008 Bauman et al.
8,313,128 B2 * 11/2012 Belyea ..... E05B 13/00 292/258
8,851,535 B2 * 10/2014 Miskel ..... E05C 19/186 292/258
2003/0111845 A1 * 6/2003 Sadler ..... E05B 5/00 292/35
2006/0207182 A1 * 9/2006 Van Parys ..... E05D 15/5208 49/192
2008/0157541 A1 7/2008 Olsen
2011/0156549 A1 * 6/2011 Zhang ..... H05K 5/02 312/223.1

* cited by examiner

DOOR SECURITY REINFORCEMENT SYSTEM

BACKGROUND OF THE INVENTION

The present invention relates to door security reinforcement system. More particularly, the present invention relates to a system which reinforces door security preventing or impeding unauthorized passage of personnel through the reinforced door.

Conventional pre-hung doors, such as the door assembly 10 shown in FIG. 1, are typically installed in a rough door opening constructed in the support structure 12 of an interior wall of residential and/or commercial buildings.

The door assembly 10 typically comprises a door 14 and a door frame 16. The door 14 comprises a first (or left) vertical side rail 18 and a second (or right) vertical side rail 20 horizontally spaced apart by top and bottom rails 22, 24. A lock rail 26 extends horizontally between the two side rails 18, 20 in a middle portion of the door 14. A mullion 28 extends from each of the top and bottom sides of the lock rail 26 to the top and bottom rails 22, 24. Panels 30 fill and close the space between the rails and mullions. The door frame 16 has a first (or left) vertical side jamb 32 and a second (or right) vertical side jamb 34 spaced apart by an upper jam 36 between the top end of the two side jambs 32, 34. A casing (or trim) 38 surrounds the two sides jambs 32, 34 and the upper jamb 36. The door 14 is attached to one of the vertical side jambs (for example, the left side jamb 18) by a plurality of hinges 40.

The support structure 12 of the interior wall typically comprises a rectangular opening framed by vertical, spaced-apart jack studs 42 attached to vertical king studs 44 forming a portion the wall support structure 12. A header 46, supported by the upper ends of the jack studs 42, in turn supports cripple studs 48 extending between the header 46 and a top wall plate 50 of the support structure 12.

During installation, upon positioning the door assembly 10 in the rough door opening, shims (not shown) are inserted between jack studs 42 and the door jambs 18, 20 to square the door assembly 10 and the door jambs 18, 20 are attached to the jack studs 42 by fasteners, such the common nail. Upon installation, the conventional door is typically releasably retained in a closed position by a door knob retractable latch (not shown) extending from the latch hole 52 in the non-hinged side rail (for example, the right side rail 20) of the door and through a strike plate (not shown) attached to the door jamb 34.

In view of the foregoing description of the construction and installation of the conventional door, Conventional door assemblies, such as the foregoing door assembly 10, can be easily breached by the application of an external force.

Accordingly, there is a need in the art for a system that reinforces door security and prevents or impedes unauthorized passage of personnel through the reinforced door.

BRIEF SUMMARY OF THE INVENTION

Briefly stated, one aspect of the present invention is directed to a security reinforcement system for door assembly having a door frame having a first vertical structural support, a second vertical structural spaced for the first vertical structural support and a hinged door between the first vertical structural support and the second vertical structural support. The reinforcement system comprises a first elongated channel having a first-channel base plate mountable to the first vertical structural support. A first plurality of security arms is pivotally attached to the first-channel base plate and movable in rotation from a first security-arm retracted position in which the first plurality of security arms is within the first elongated channel to a first security-arm extended position beyond the first elongated channel and in which position each security arm of the first plurality of security arms extends across a portion of the door and reinforces the door when the first elongated channel is mounted to the first vertical support structure. A first actuator is rotatably attached to the first-channel base plate and operatively coupled to the first plurality of security arms. Rotation of the first actuator from a first-actuator first position in which the first plurality of security arms is in the first security-arm retracted position to a first-actuator second position rotates the first plurality of security arms from the first security-arm retracted position to the first security-arm extended position.

Another aspect of the present invention is directed to security reinforcement system for a double door assembly having a door frame having a first vertical structural support, a second vertical structural support spaced form the first vertical structural support, a header supported by the first and second vertical structural supports and a hinged door below the header and between the first vertical structural support and the second vertical structural support. The reinforcement system comprises a housing having a generally rectangular-shaped housing base plate mountable on the header, top, bottom, left and right sidewalls extending from the housing base plate and a removable face plate closing the housing. The bottom sidewall has a first slot and a second slot spaced from the first slot. A first security arm is pivotably mounted to the base plate proximate the first slot. The first security arm is movable in rotation from a first security-arm retracted position, in which the first security arm is within the housing to a first security-arm extended position through and beyond the first slot and in which position the first security arm extends across a portion of the door and reinforces the door when the base plate is attached to the header. A second security arm is pivotably mounted to the base plate proximate the second slot. The second security arm is movable in rotation from a second security-arm retracted position, in which the second security arm is within the housing to a second security-arm extended position through and beyond the second slot and in which position the second security arm extends across another portion of the door and reinforces the door when the base plate is attached to the header. An actuator pivotally is attached to the base plate at a location generally equidistant from and operatively coupled to the first and second security arms. Rotation of the actuator from an actuator first position in which the first and second security arms are in the first and second security-arm retracted positions to an actuator second position rotates the first and security arms from the first and second security-arm retracted positions to the first and second security-arm extended positions.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, the drawings show embodiments which are presently preferred. It should be understood, however, that the invention is not limited to the precise arrangements and instrumentalities shown.

In the drawings.

DETAILED DESCRIPTION OF THE INVENTION

Figure 1:
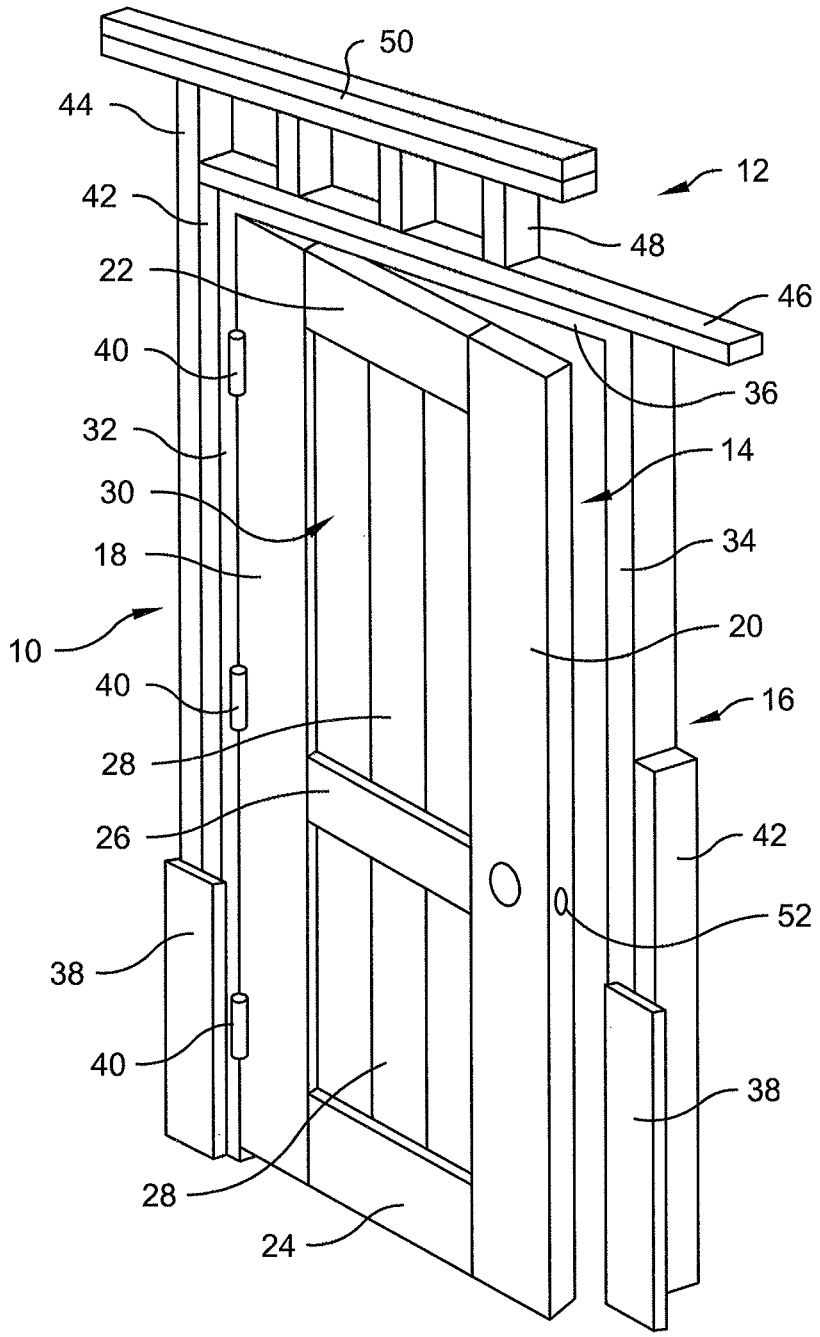
Fig. 1 (Prior Art)
FIG. 1 is a perspective front elevation view partially in cross section of an installed prior art door assembly.

Reference will now be made in detail to embodiments of the invention, examples of which are illustrated in the accompanying drawings. The terminology used in the description of the invention herein is for the purpose of describing particular embodiments only and is not intended to be limiting of the invention.

As used in the description of the invention and the appended claims, the singular forms "a", "an" and "the" are intended to include the plural forms as well, unless the context clearly indicates otherwise. The words "and/or" as used herein refers to and encompasses any and all possible combinations of one or more of the associated listed items. The words "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The words "right," "left," "lower" and "upper" designate directions in the drawings to which reference is made. The words "inwardly" and "outwardly" refer to directions toward and away from, respectively, the geometric center of the needle safety shield, and designated parts thereof. The terminology includes the words noted above, derivatives thereof and words of similar import.

Although the words first, second, etc., are used herein to describe various elements, these elements should not be limited by these words. These words are only used to distinguish one element from another. For example, a first security arm could be termed a second security arm, and, similarly, a second security arm could be termed a first security arm, without departing from the scope of the present invention.

As used herein, the words "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context.

The following description is directed towards various embodiments of a door security reinforcement system in accordance with the present invention.

Referring to the drawings in detail, where like numerals indicate like elements throughout, there is shown in FIGS. 2-10 a first preferred embodiment of the door security reinforcement system, generally designated 100, and hereinafter referred to as the "reinforcement system" 100 in accordance with the present invention. The reinforcement system 100 is for use with door assemblies comprising a door frame having a first vertical structural support, a second vertical structural support spaced from the first vertical structural support and a hinged door between the first and second vertical structural supports. The reinforcement system 100 strengthens existing door frame components, such as the first and second side jambs 18, 20 shown in FIG. 1, by adding additional structural support to the side rails. The reinforcement system 100 also prevents normal operation of a door by impeding or preventing the entry of unauthorized personnel through the door.

The reinforcement system 100 comprises a first elongated channel 102 (shown in FIG. 3) having a first-channel base plate 104 mountable to the first vertical structural support of a door frame (for example, the first or left side jamb 32 of the door frame 16 shown in FIG. 1) and a second elongated channel 202 having a second-channel base plate 204 mountable to the second vertical structural support of a door frame (for example, the second or right side door jamb 36 of the door frame 16 shown in FIG. 1).

The first and second elongated channels 102, 202 may be formed from a variety of materials as a single-piece construction or a multi-piece construction having a length and width corresponding to the length and width of the vertical support structures to which the channels 102, 202 are being mounted. Desirably, one of the possible construction materials is steel, preferably AR500 ¼ or ⅜ grade steel, although other metals may be used. Alternatively, the construction material may be a non-metallic material such as a polymeric material, preferably fiber reinforced. Although the thickness of the construction material may desirably be ¼ inch and preferably ⅜ inch, in some embodiments the thickness may be less than ¼ inch or greater than ⅜ inch.

The first and second elongated channels 102, 202 may have a generally U-shaped or box-like cross section with sidewalls 110 extending upwardly from a base that serves as the base-plate 104, 204. In some embodiments, the base plate 104, 204 may be reinforced with an additional plate bonded thereto. In other:embodiments, the base plate 104, 204 and the sidewalls 110 may be fabricated from different materials welded or bonded to the base plate to form the desired shape for each channel 102, 202. In some embodiments, the sidewalls 110 may be continuous and have a plurality of slots or cut-outs 112 therein and through which components of the reinforcement system 100 may retractably extend. In other embodiments, the sidewalls 110 may comprise multiple pieces spaced apart a sufficient distance to allow for the retractable extension of components of the reinforcement system 100 in the slots 112 formed between the spaced-apart pieces.

End caps 114 and a face plate 116 (Shown in FIGS. 2 and 3) may be provided for removable attachment to each channel 102, 202 by any of a number of well known methods such as a snap fit or by the use of fasteners such as screws to form a substantially closed housing for the reinforcement system 100. The end caps 114 and face plates 116 may be fabricated from the same material as the channel or from different materials.

A plurality of uniformly spaced-apart bolt holes 118 are provided in each base-plate 104, 204 to receive therein bolts to securely mount the elongated channels 102, 202 to the first and second vertical structural supports (or side door jambs) 32, 34 of the door frame 16.

Figure 2:
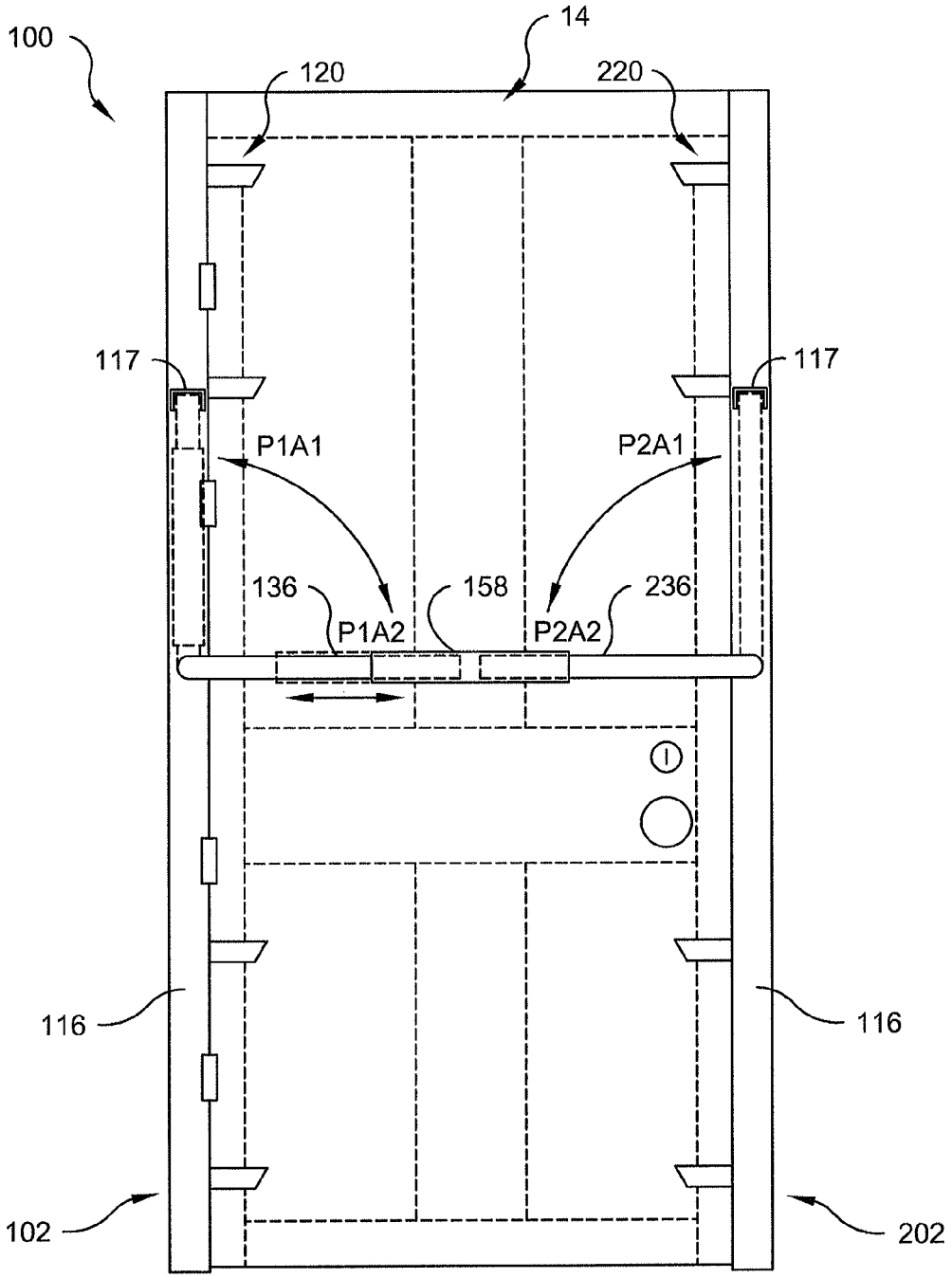
FIG. 2 is a front elevation view of a first preferred embodiment of the door security reinforcement system mounted on a door frame in accordance with the present invention.

A first plurality of security arms 120 is pivotally attached to the first-channel base plate 102. Each security arm 122 of the first plurality of security arms 120 is movable in rotation from a first security-arm retracted position P1Sr (shown in FIG. 5) to a first security-arm extended position P1Se (shown in FIG. 4). In the first security-arm extended position P1Se, a portion of each security arm 122 extends beyond the sidewall 110 of the first elongated channel 102 and across a portion of the door 14, thereby reinforcing the door 14 when the first elongated channel 102 is mounted to the first vertical support structure 32 as shown in FIG. 2. In the first security-arm retracted position P1Sr, each security arm 122 is within the first elongated channel 102. Preferably, but not necessarily, the upper edge of the portion of the security arm 122 extending from the first elongated channel when the security arm is in the extended position P1Se is flush with the outer edge of the sidewall 110 of first elongated channel 102 when the security arm 122 is in the security-arm retracted position P1Sr.

In a first security-arm extended position P1Se, each security arm 122 extends suggestedly at least about five percent of the width of the door, desirably about ten or more percent of the width of the door, preferably between about fifteen to twenty percent of the width of the door, and less preferably up to twenty-five percent of the width of the door, but no more than thirty percent of the width of the door.

Figure 4:
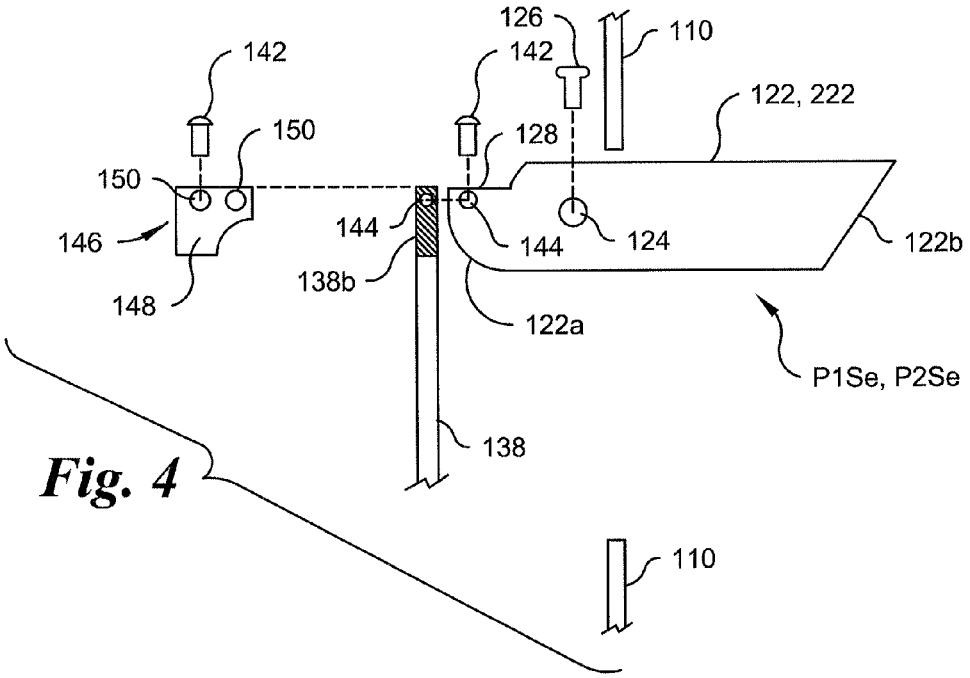
FIG. 4 is a front elevation view of one of the security bars in FIG. 3 in the extended position.
Figure 5:
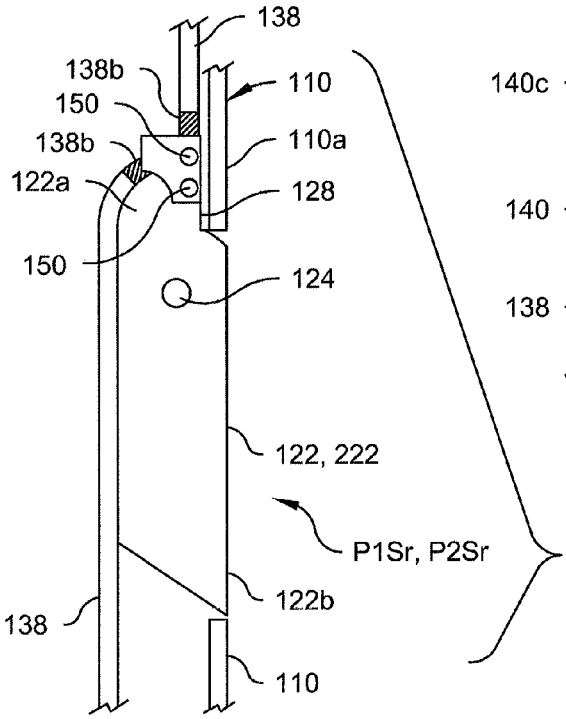
FIG. 5 is a front elevation view of one of the security bars in FIG. 3 in the retracted position.

Referring to FIGS. 4 and 5, each security arm 122 may be a plate, preferably but not necessarily, fabricated from the same material as the first elongated channel 102. Alternatively, in some embodiments, each security arm may be a rod; in other embodiments each security arm may be a tube.

Each security arm 122 has a first end 122*a* within the first elongated channel 102 and a second end 122*b* extendable beyond the first elongated channel 102. A security-arm pivot hole 124 in the security arm 122 is spaced from the first end 122*a* of the security arm 122 and receives therein a security-arm pivot pin 126 pivotally attaching the security arm 122 to the first-channel base plate 104. A setback 128 in the upper edge of the security arm 122 extends from the first end 122*a* toward the second end 122*b* and has a length and depth as required to receive a portion 110*a* of the sidewall 110 when the security arm 122 is in the first security-arm retracted position P1Sr as shown in FIG. 5.

Figure 7:
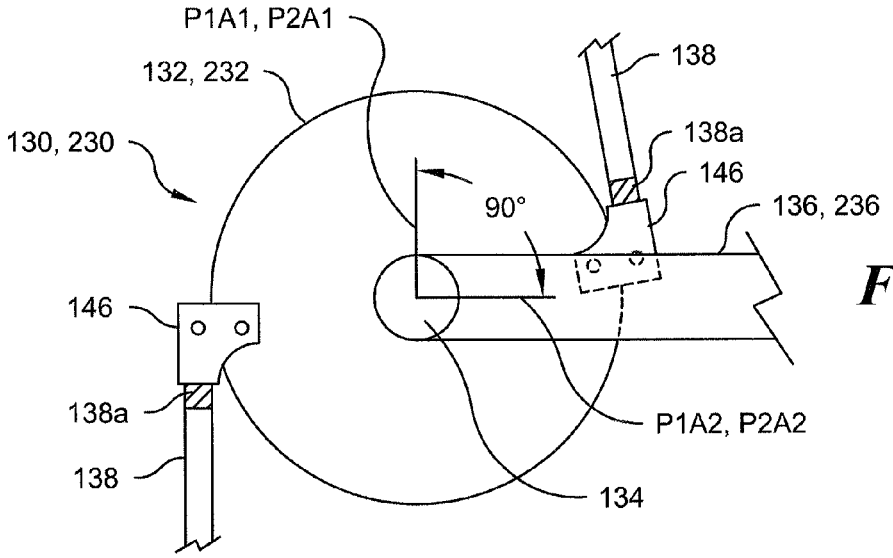
FIG. 7 is an enlarged front elevation view of the actuator of FIG. 3.

Referring to FIG. 7, a first actuator 130 is rotatably attached to the first-channel base plate 104 and operatively coupled to the first plurality of security arms 120. Rotation of the first actuator 130 from a first-actuator first position P1A1, in which the first plurality of security arms 120 is in the first security-arm retracted position P1Sr, to a first-actuator second position P1A2 rotates the first plurality of security arms 120 from the first security-arm retracted position P1Sr to the first security-arm extended position P1Se.

Figure 8:
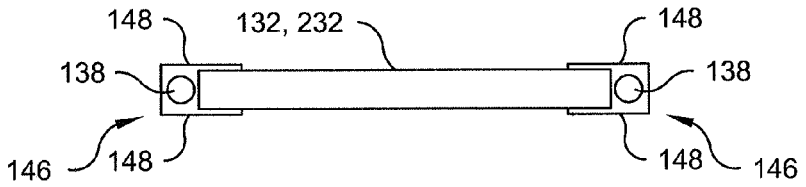
FIG. 8 is a top plan view in cross-section of the actuator of FIG. 7.
Figure 9:
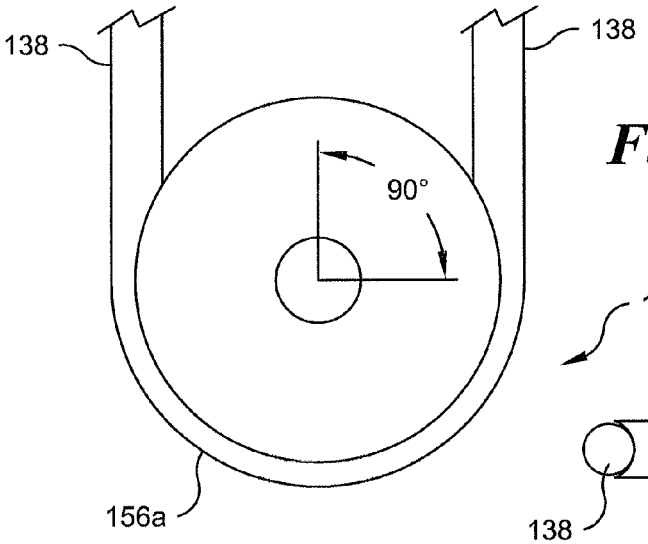
FIG. 9 is an enlarged front elevation view of the second disk of FIG. 3.
Figure 10:
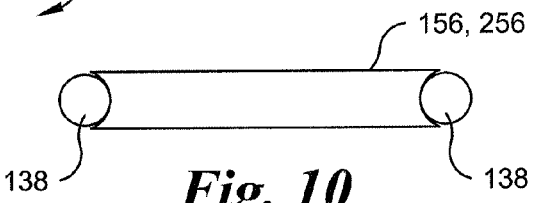
FIG. 10 is a top plan view in cross section of the second disk of FIG. 9.

Referring to FIGS. 7 and 8, in some embodiments, the first actuator 130 comprises a first disk 132 rotatably attached to the first-channel base plate 104 by an actuator shaft 134 fixedly attached to the first-channel base plate 104 and about which the first disk 132 may rotate. The first disk 132 may have a first-actuator activating arm 136 attached thereto, the application of a force to which rotates the first disk 132. In some embodiments, a boss fixedly attached to the first disk 132 extends outwardly through a bore in the faceplate 116 and provides a mount to which the first-actuator activating arm 136 may be attached. The faceplate 116 may also have a catch 117 (see FIG. 2) which releasably retains the first-actuator activating arm 136 in the first-actuator first position P1A1. A key-activated lock (not shown) may be installed in the first-actuator activating arm 136 and operatively coupled to the catch 117 or to the first elongated channel 102 to prevent: unauthorized activation of the reinforcement system 100.

Figure 6:
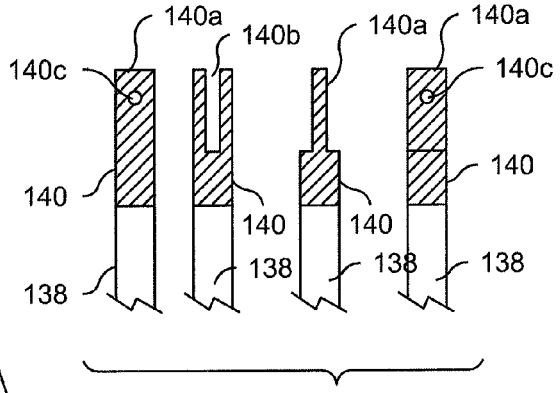
FIG. 6 shows multiple views of the cable cap of FIG. 4.

The first disk 132 may also be operatively coupled to each security arm 122 of the first plurality of security arms 120 by one or more cables 138 having a first end 138*a* pivotally attachable to the first disk 132 (see FIG. 7) and a second end 138*b* pivotally attachable to the first end 122*a* of the security arm 122 (see FIGS. 4 and 5). Referring to FIG. 6, the cable 138 may be terminated with a cable cap 140 configured as a tongue 140*a* or groove 140*b*, each with a cable-cap bore 140*c* therethrough to facilitate direct attachment of the cable cap 140 to the first disk 132 or security arm 122 by a cable pivot pin 142 inserted through the cable-cap bore 140*c* and into a corresponding cable pivot-pin bore 144 proximate the circumference of the first disk 132 or proximate the first end 122*a* of the security arm 122.

In some embodiments the cable caps 138 are pivotally attached to the first disk 132 and the security arms 122 by a cable latch 146 having a generally U-shaped configuration with opposed, spaced-apart side panels 148 each of which has a pair of latch pivot holes 150 for receiving a cable pivot pin 142. (See, FIGS. 4, 5, 7 and 8) Positioning a peripheral portion of the first disk 132 or the first end 122*a* of a security arm 122 between the latch side panels 148 such that one of the latch pivot holes 150 in each side panel 148 is in alignment with the cable pivot pin bore 144 in the first disk 132 or in the security arm 122 and positioning the cable cap bore 140*c* between the side panels 148 and in alignment with the other one of the latch pivot holes 150 in each side panel 148 is in alignment with the cable cap bore 140*c* followed by the insertion of a cable pivot pin 142 in the aligned bores, pivotally couples the cable 138 to the first disk 132 and/or the security arm 122.

Figure 13A:
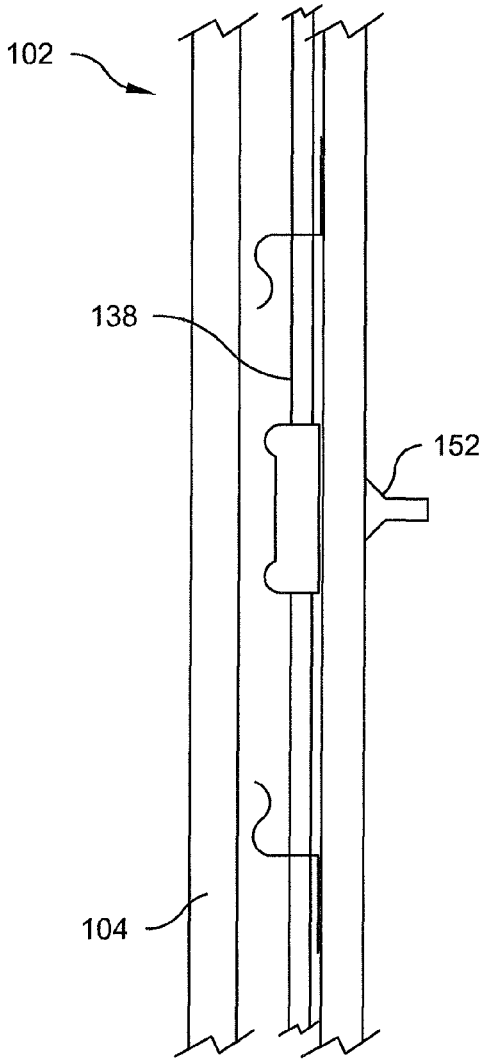
FIG. 13A and FIG. 13B show multiple views of a preferred embodiment of a finger slide for activating the activator of FIG. 3 in accordance with the present invention.
Figure 13B:
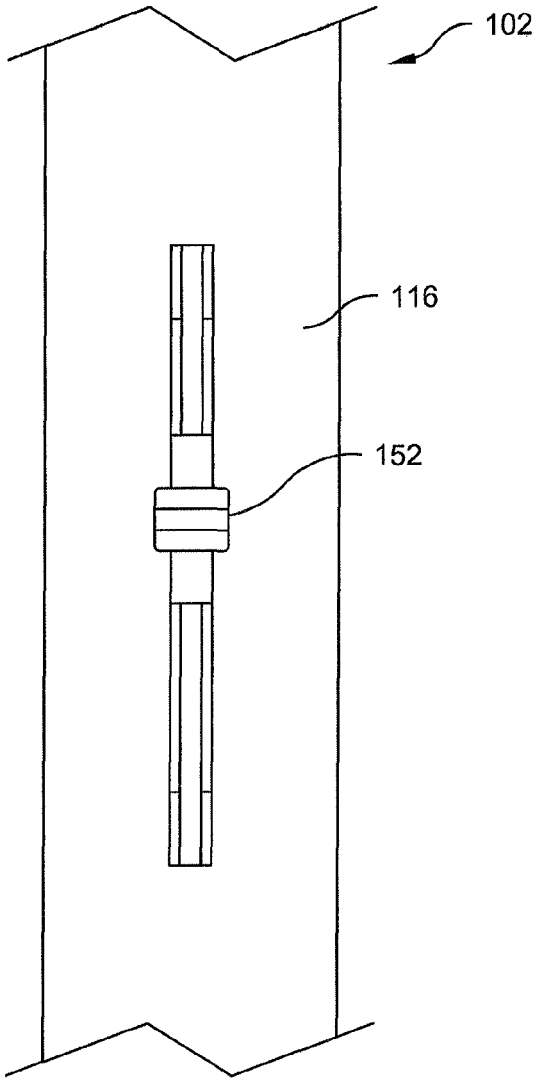

In some embodiments, the cable latch 146 may be replaced by a shackle (not shown). In other embodiments the first-actuator activating arm 136 may be replaced by a finger slide 152 (See, FIGS. 13A and 13B) fixedly attached to one of the cables 138 for movement therewith, which movement causes a rotation of the first disk 132. In still other embodiments, the first disk 132 may be rotated by a remote controllable electric motor 160 attached thereto (See, FIG.

12). In yet other embodiments, the first actuator 130 may further comprise a ratchet (not shown) releasably holding the first actuator 130 in the first actuator second position P1A2.

Figure 11:
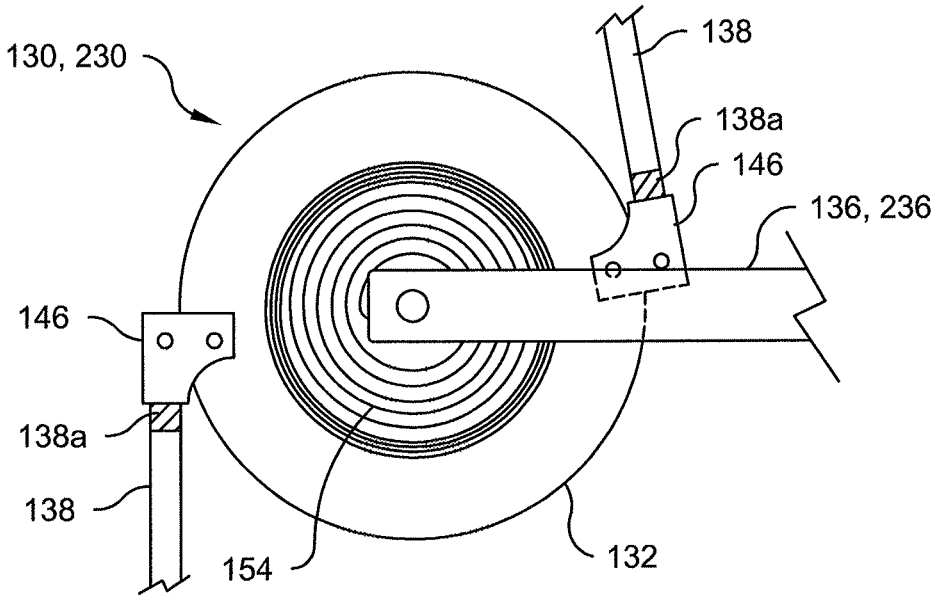
FIG. 11 is an enlarged front elevation view of another embodiment of the actuator of the present invention.
Figure 12:
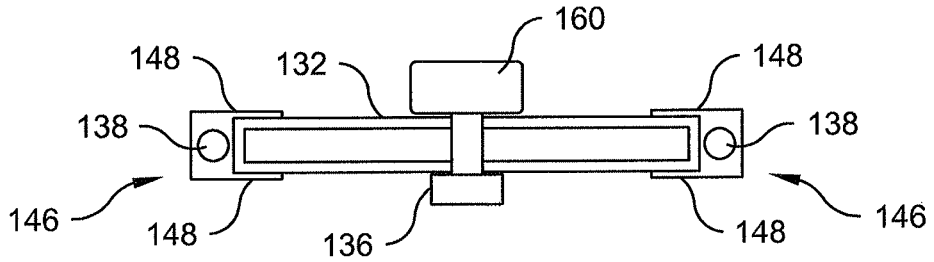
FIG. 12 is a top plan view in cross section of another embodiment of the actuator of the present invention.

In another preferred embodiment of the security reinforcement system 100, instead of cables coupling the first plurality of security arms 120 to the actuator 130, one or more connecting rods 152 may be used. For example, referring to FIG. 14, each security arm 122 of the first plurality of security arms 120 may be operatively coupled to the first disk 132 by a single rod 152 pivotally attached to the first disk 132 and also to the first end 122*a* of each security arm 122 of the first plurality of security arms 120. In addition, a biasing member 154, such as a coil spring shown in FIG. 11, may be coupled to the first disk 132 to bias the first disk 132 in the first-actuator first position P1A1.

Figure 3:
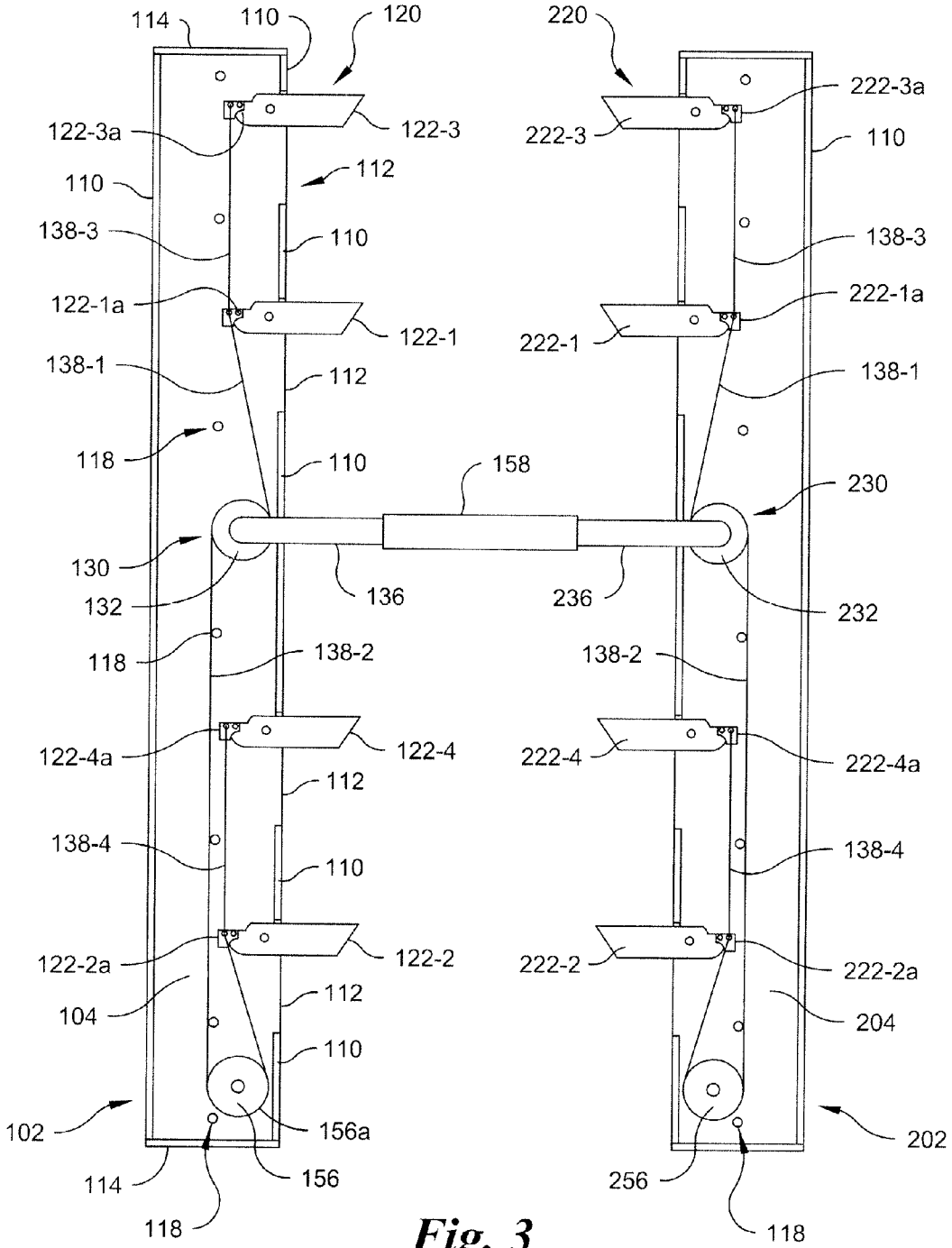
FIG. 3 is a front elevation view in cross-section of the door security reinforcement system of FIG. 2.

Referring to FIG. 3, in some embodiments, the first plurality of security arms 120 comprises at least a first security arm 122-1 and a second security arm 122-2. A second disk 156 may be provided and may be rotatably attached to the first elongated channel 102. The first disk 132 is preferably between the first security arm 122-1 and the second security arm 122-2. The first security arm 122-1 may be operatively coupled to the first disk 132 by a first cable 138-1 having a first end pivotally attached to the first disk 132 and a second end pivotally attached to the first security arm 122-1. The second security arm 122-2 is preferably between the first disk 132 and the second disk 156 and may be operatively coupled to the first disk 132 by a second cable 138-2 extending from the first disk 132 around a circumferential portion 156*a* of the second disk 156 to the second security arm 122-2 and having a first end pivotally attached to the first disk 132 and a second end pivotally attached to the second security arm 122-2.

In other embodiments the first plurality of security arms 120 may further comprise a third security arm 122-3 and a fourth security arm 122-4. The third security arm 122-3 may be pivotally attached to the first elongated channel 102 above the first security arm 122-1. The third security arm 122-3 may be operatively coupled to the first disk 132 by a third cable 138-3 having a first end pivotally attached to the first end 122-3*a* of the third security arm 122-3 and a second end pivotally attached to the first end 122-1*a* of the first security arm 122-1 such that the third security arm 122-3 rotates in synchrony with the first security arm 122-1. The fourth security arm 122-4 may be pivotally attached to the first elongated channel 102 between the second security arm 122-2 and the first disk 132. The fourth security arm 122-4 may be operatively coupled to the first disk 132 by a fourth cable 138-4 having a first end pivotally attached to the first end 122-4*a* of the fourth security arm 122-4 and a second end pivotally attached to the first end 122-2*a* of the second security arm 122-2 such that the fourth security arm 122-4 rotates in synchrony with the second security arm 122-2.

In another preferred embodiment, the first, second, third, and fourth cables 122-1, 122-2, 122-3 and 122-4 may be replaced with four rods (not shown). In such an embodiment, the second and fourth rods do not circumscribe a circumferential portion of the second disk 156; instead, they are pivotally attached to the second disk at each end of a diameter of the second disk 156.

The second elongated channel 202 has substantially the same structure as the first elongated channel 102. Referring to FIG. 3, a second plurality of security arms 220 is pivotally attached to the second-channel base plate 204. Each security arm 222 of the second plurality of security arms 220 is movable in rotation from a second security-arm retracted position P2Sr in which the second plurality of security arms 220 is within the second elongated channel 202 to a second security-arm extended position P2Se beyond the second elongated channel 202 and in which position each security arm 222 of the second plurality of security arms 220 extends toward the first elongated channel 102 across a portion of the door 14 and reinforces the door 14 when the first elongated channel 102 is mounted to the first vertical support structure 18 and the second elongated channel 202 is mounted to the second vertical support structure 20. Each security arm 222 of the second plurality of security arms 110 is substantially the same as each security arm 122 of the first plurality of security arms 120 and for brevity is not further described here.

A second actuator 230 is rotatably attached to the second-channel base plate 204 and operatively coupled to the second plurality of security arms 220. Rotation of the second actuator 230 from a second-actuator first position P2A1 in which the second plurality of security arms 220 is in the retracted position P2Sr to a second-actuator second position P2A2 rotates the second plurality of security arms 220 from the retracted position P2Sr toward the first elongated channel 102 and into the extended position P2Se when the first elongated channel 102 is mounted to the first vertical support structure 18 and the second elongated channel 202 is mounted to the second vertical support structure 20.

The second actuator 230 is rotatable by a second actuator arm 236 attached thereto. When the first actuator arm 136 rotates the first actuator 130 to the first-actuator second position P1A2, thereby causing the first plurality of security arms 120 to be in the first security-arm extended position P1Se, and when the second actuator arm 236 rotates the second actuator 230 to the second-actuator second position P2A2, thereby the second plurality of security arms 220 to be in the second security-arm extended position P2Se, the first and second actuator arms 136, 236 are releasably retainable in a horizontal position by a sleeve 158 slideably retained on the first actuating arm and slidable to a coupling position in which a portion of the first and second actuator arms 136, 236 are within the sleeve 158.

In some embodiments, the second actuator 230 may be another first disk 232 having the same properties as the first disk 132. In such embodiments, each security arm 222 of the second plurality of security arms 220 is operatively coupled to the another first disk 232 by another cable 238 having a first end pivotally attached to the another first disk 232 and a second end pivotally attached to the security arm 222 of the second plurality of security arms 220.

In some embodiments, the second plurality of security arms 220 comprises at least another first security arm 222-1 and another second security arm 222-2. Another second disk 256 substantially the same as the second disk 156 may be provided and may be rotatably attached to the second elongated channel 202. The another first disk 232 is preferably between the another first security arm 222-1 and the another second security arm 222-2. The another first security arm 222-1 may be operatively coupled to the another first disk 232 by a first cable 138-1 having a first end pivotally attached to the another first disk 232 and a second end pivotally attached to the another first security arm 222-1. The another second security arm 222-2 is preferably between the another first disk 232 and the another second disk 256 and may be operatively coupled to the another first disk 232 by a second cable 138-2 extending from the another first disk 232 around a circumferential portion 256*a* of the another second disk 256 to the another second security arm 222-2 and having a first end pivotally attached to the another first disk 232 and a second end pivotally attached to the another second security arm 222-2.

In other embodiments the second plurality of security arms 220 may further comprise another third security arm 222-3 and another fourth security arm 222-4. The another third security arm 222-3 may be pivotally attached to the first elongated channel 202 above the another first security arm 222-1. The another third security arm 222-3 may be operatively coupled to the another first disk 232 by a third cable 138-3 having a first end pivotally attached to the first end 222-3*a* of the another third security arm 222-3 and a second end pivotally attached to the first end 222-1*a* of the another first security arm 222-1 such that the another third security arm 222-3 rotates in synchrony with the another first security arm 222-1. The another fourth security arm 222-4 may be pivotally attached to the first elongated channel 202 between the another second security arm 222-2 and the another first disk 232. The another fourth security arm 222-4 may be operatively coupled to the another first disk 232 by a fourth cable 138-4 having a first end pivotally attached to the first end 222-4*a* of the another fourth security arm 222-4 and a second end pivotally attached to the first end 222-2*a* of the another second security arm 222-2 such that the another fourth security arm 222-4 rotates in synchrony with the another second security arm 222-2.

Figure 14:
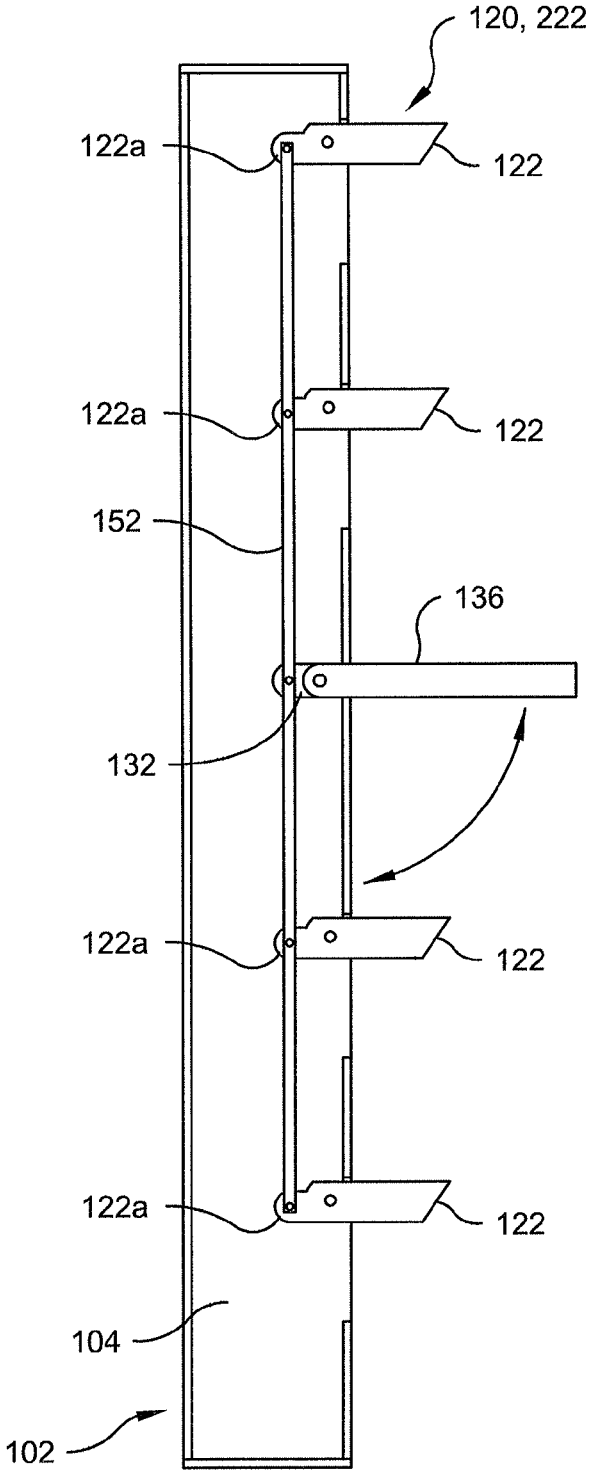
FIG. 14 is a front elevation view in cross section of a first elongated channel in accordance with another preferred embodiment of the present invention.
Figure 17:
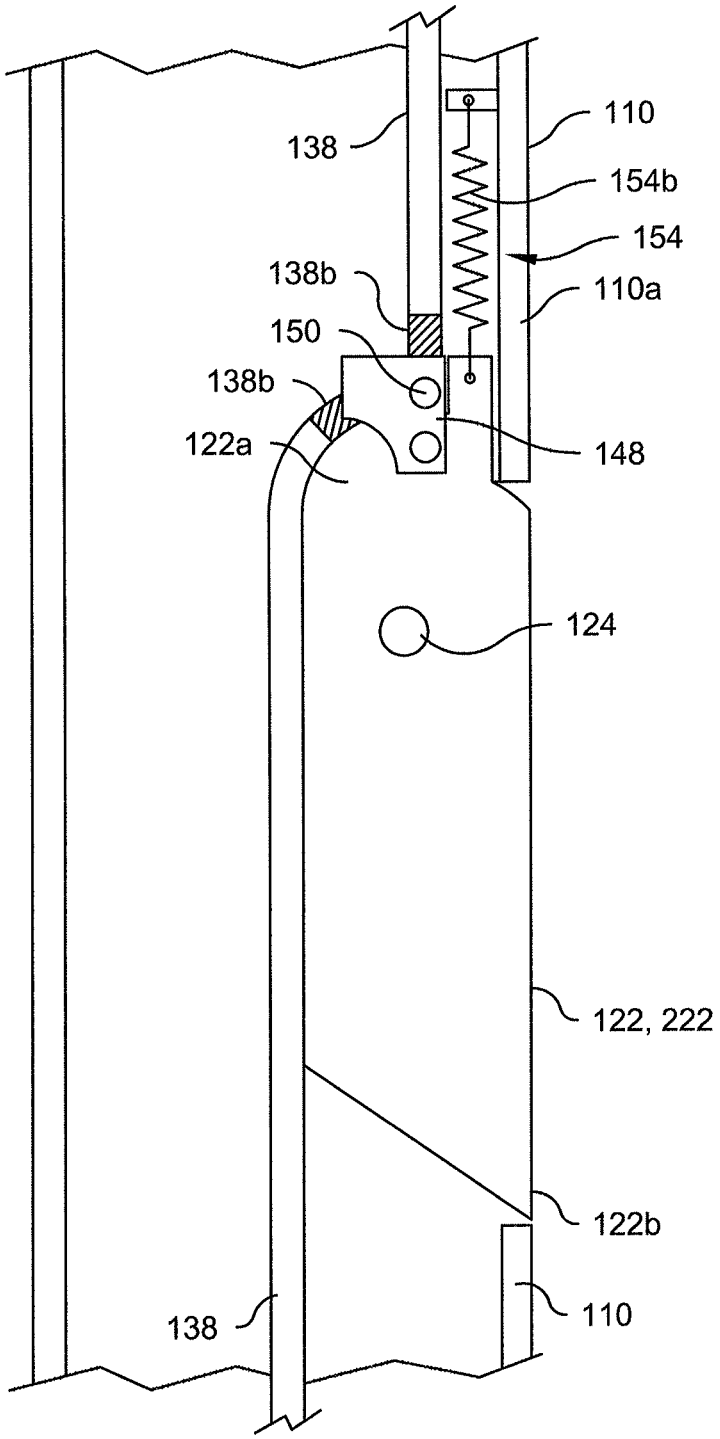
FIG. 17 is a front elevation view of one of the security bars in FIG. 3 biased in the retracted position.

In another preferred embodiment, instead of cables 138 coupling the second plurality of security arms 220 to the actuator 230, a single rod 152 may be used to operatively couple each security arm 222 of the first plurality of security arms 220 to the another first disk 232 in substantially the same way the first plurality of security arms 120 are coupled to the first disk 132 in FIG. 14. In addition, a biasing member 154, such as a coil spring 154*a* shown in FIG. 11, may be coupled to the another first disk 232 to bias the another first disk 232 in the second-actuator first position P2A1. In some embodiments, a biasing member 154, such as the tension spring 154*b* shown in FIG. 17, may be attached to and extend between the first end 122*a* of at least one security arm 122 of the first plurality of security arms 120 and the first channel base plate 104 and another tension spring 154*b* may be attached to and extend between the first end 222*a* of at least one security arm 222 of the first plurality of security arms 220 and the first channel base plate 204.

Figure 15:
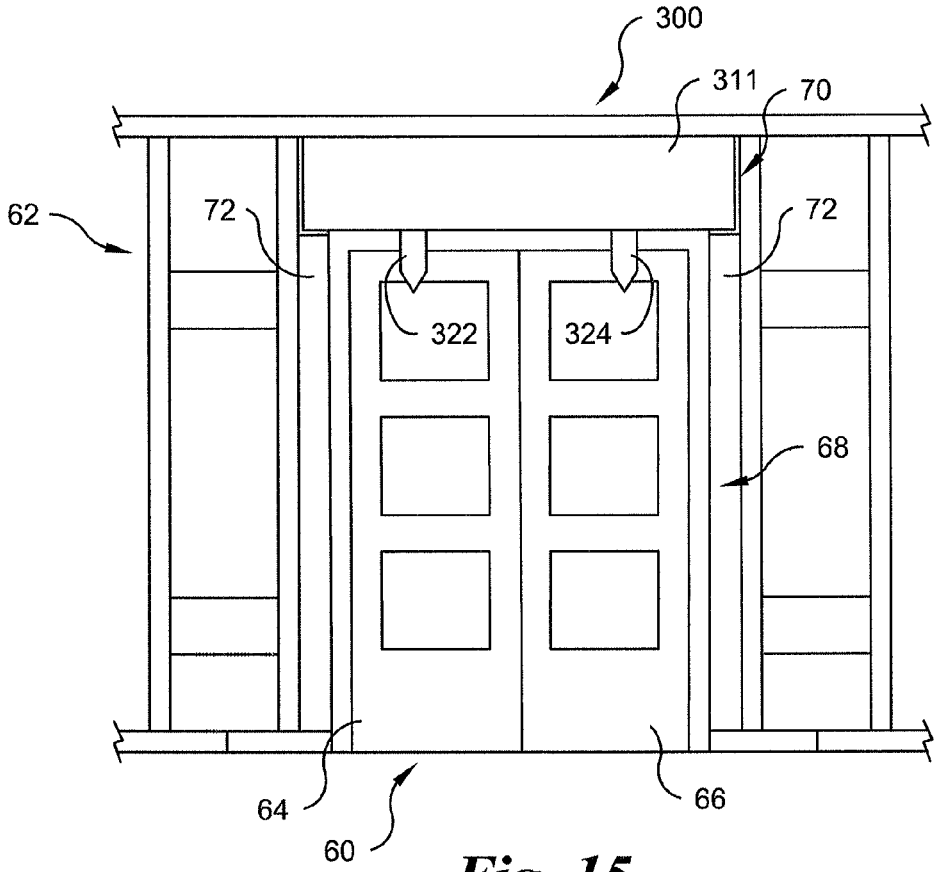
FIG. 15 is a front elevation view of a preferred embodiment of the door security reinforcement system for a double door in accordance with the present invention.
Figure 16:
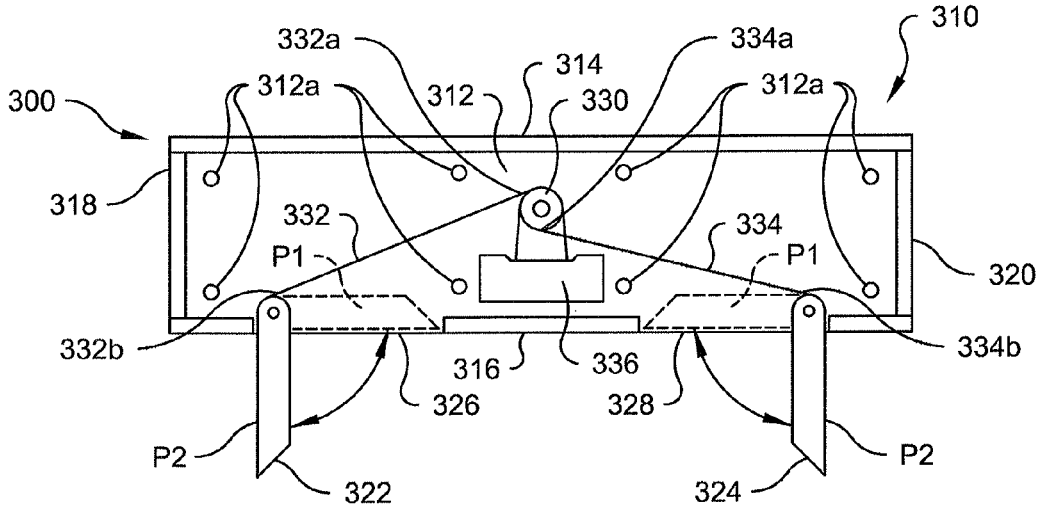
FIG. 16 is a front elevation view in cross section of the door security reinforcement system in FIG. 15.

Referring to FIGS. 15 and 16, there is shown a preferred embodiment of another aspect of the present invention hereafter referred to as the reinforcement system 300 directed to reinforcing double doors, such as the double door 60 installed in the interior wall support structure 62. The double door 60 has a first (or left) door 64 and a second (or right) door 66. The double door 60 has a door frame 68 installed below a header 70 and between jack studs 72 supporting the header 70.

The reinforcement system 300 comprises a housing 310 having a generally rectangular-shaped housing base plate 312, top, bottom, left and right sidewalls respectively designated 314, 316, 318, and 320, extending from the housing base plate 312 and a removable face plate 311 closing the housing 310. The base plate 312 has a width and a length corresponding to the width and length of the header 70 to which the base plate 312 is mountable. The typical header 70 has a length of approximately 62 inch or 72 inch although the header for custom door rough openings in the interior wall support structure 62 may be less than 62 inch, more than 72 inch or between 62 inch and 72 inch. The typical header has a width of approximately 8 inch. However, the width may be more or less that 8 inch in custom installations. The base plate has a plurality of bolt hole 312*a* to receive bolts attaching the base plate to the header 70.

First and second security arms 322, 324 having substantially the same features as the security arms 122 and 222 of the reinforcement system 100 disclosed above are pivotally mounted to the base plate 312 at spaced apart locations proximal to first and second slots 326, 328 in the bottom sidewall 316. An activating cam 330 is pivotally attached to the base plate 312 at a location generally equidistant from the first and second security arms 322, 324. The first security arm 322 is operatively coupled to the activating cam 330 by a first rod 332 having a first end 332*a* pivotally attached to the cam 330 and a second end 332*b* pivotally attached to the first security arm 322. The second security arm 324 is operatively coupled to the activating cam 330 by a second rod 334 having a first end 334*a* pivotally attached to the cam 330 and a second end 334*b* pivotally attached to the, first security arm 322. A remotely controlled cam driver 336 is mounted to the base plate 312 and operatively coupled to the cam 330.

The cam driver 336 has a controller (not shown) configured to rotate the cam 330 in a manner that causes the first and second rods 332, 334 to rotate the first and second security arms 322, 324 between a first position P1 in which the security arms are retracted and within the housing 310 and a second position P2 in which the security arms extend through the slots 326 in the bottom sidewall 316 and over a portion of the top of the right and left doors 64, 66.

The foregoing detailed description of the invention has been disclosed with reference to specific embodiments. However, the disclosure is not intended to be exhaustive or to limit the invention to the precise forms disclosed. Those skilled in the art will appreciate that changes could be made to the embodiments described above without departing from the broad inventive concept thereof. Therefore, the disclosure is intended to cover modifications within the spirit and scope of the present invention as defined by the appended claims.

I claim:

1. A security reinforcement system for a door assembly comprising a door frame having a vertical structural support, another vertical structural support spaced from the vertical structural support and a hinged door positioned between the vertical structural support and the another vertical structural support, the reinforcement system comprising:

an elongated channel having a channel base plate mountable to the vertical structural support;

a plurality of security arms pivotally attached to the channel base plate and movable in rotation from a security-arm retracted position, in which the plurality of security arms are located within the elongated channel, to a security-arm extended position, in which the plurality of security arms are pivoted beyond the elongated channel and extend across a portion of an outside surface of the door and reinforces a side of the door where the elongated channel is mounted to the vertical support structure;

an actuator mechanism rotateably attached to the channel base plate and operatively coupled to the plurality of security arms, wherein the actuator mechanism is rotated between a non-actuated position, in which the plurality of security arms are in the security-arm retracted position, to an actuated position in which the plurality of security arms rotate in the same direction from the security-arm retracted position to the security-arm extended position;

an actuator activation arm mounted to the vertical support structure and operably connected to the actuator mechanism, the actuator activation arm rotating between a vertical non-activating position to a horizontal activation position, in which the actuator activation arm operates the actuator mechanism to the actuated positon, wherein the actuator activation arm is positioned to extend across a portion of the outside surface of the door where the elongated channel is mounted to the vertical support structure;

another elongated channel having another channel base plate mountable to the another vertical structural support;

another plurality of security arms pivotally attached to the another channel base plate and movable in rotation from a security-arm retracted position, in which the another plurality of security arms are located within the another elongated channel, to a security-arm extended position, in which the another plurality of security arms are pivoted beyond the another elongated channel and extend across another portion of the outside surface of the door and reinforces another side of the door where the another elongated channel is mounted to the another vertical support structure; and another actuator mechanism rotateably attached to the another channel base plate and operatively coupled to the another plurality of security arms, wherein the another actuator mechanism is rotated between a non-actuated position, in which the another plurality of security arms are in the security-arm retracted position, to an actuated position in which the another plurality of security arms rotate in the same direction from the security-arm retracted position to the security-arm extended position;

another actuator activation arm mounted on the another vertical structural support and operably connected to the another actuator mechanism, the another actuator activation arm rotating between a vertical non-activating position to a horizontal activation position, in which the another actuator activation arm operates the another actuator mechanism to the actuated positon, wherein the another actuator activation arm is positioned to extend across a portion of the outside surface of the door where the another elongated channel is mounted to the another vertical support structure; and a sleeve coupled to ends of each activation arm to retain each activation arm in the horizontal position and maintain the reinforcing of each plurality of security arms on the outside surface of the door.

2. The security reinforcement system according to claim 1, wherein the actuator mechanism comprises a disk rotatable by an actuator activation arm attached thereto and each security arm of the plurality of security arms is operatively coupled to the disk by one or more cables of a plurality of cables, each cable having an end pivotally attachable to the disk and another end pivotally attachable to the security arm.

3. The security reinforcement system according to claim 1, wherein each security arm of the plurality of security arms is operatively coupled to the actuator mechanism by a cable having an end pivotally attached to the actuator mechanism and another end pivotally attached to the security arm, and wherein the actuator mechanism is rotatable by a movement of a finger slide fixedly attached to one of the cables for movement therewith.

4. The security reinforcement system according to claim 1, wherein the actuator mechanism comprises a disk rotatable by an electric motor attached thereto.

5. The security reinforcement system according to claim 1, wherein the actuator mechanism comprises a disk rotatable by an actuator activation arm attached thereto and each security arm of the plurality of security arms is operatively coupled to the disk by a rod pivotally attached to the disk and to the end of each security arm of the plurality of security arms.

6. The security reinforcement system according to claim 1, wherein the actuator mechanism comprises a disk rotatable by an actuator activation arm attached thereto and a biasing member coupled thereto, the biasing member biasing the actuator mechanism in the actuator mechanism position and wherein each security arm of the plurality of security arms is operatively coupled to the disk by a rod pivotally attached to the disk and to the end of each security arm of the plurality of security arms.

7. The security reinforcement system according to claim 1, wherein the plurality of security arms comprises at least a security arm and another security arm, the actuator mechanism is a disk, another disk is rotatably attached to the elongated channel, the disk is between the security arm and the another security arm, the security arm is operatively coupled to the disk by a cable having an end pivotally attached to the disk and another end pivotally attached to the security arm, the another security arm is between the disk and the another disk and the another security arm is operatively coupled to the disk by another cable extending from the disk around a portion of a circumference of the another disk to the another security arm and having an end pivotally attached to the disk and another end pivotally attached to the another security arm.

8. The security reinforcement system according to claim 7, wherein the plurality of security arms further comprises still another security arm pivotally attached to the elongated channel above the security arm and operatively coupled to the security arm by still another cable between the still another security arm and the security arm and a yet another security arm pivotally attached to the elongated channel between the another security arm and the disk and operatively coupled to the another security arm by a fourth cable between the fourth security arm and the another security arm and wherein the third security arm rotates in synchrony with the rotation of the security arm and the fourth security arm rotated in synchrony with the another security arm.

9. The security reinforcement system according to claim 1, wherein the actuator is a disk and each security arm of the plurality of security arms is operatively coupled to the disk by one or more cables of a plurality of cables having a end pivotally attachable to the disk and another end pivotally attachable to the security arm, and wherein the another actuator is a another disk and each security arm of the another plurality of security arms is operatively coupled to the another disk by one or more another cables of a plurality of another cables having an end pivotally attachable to the another disk and another end pivotally attachable to the security arm of the another plurality of security arms.

10. The security reinforcement system according to claim 1, wherein the plurality of security arms comprises at least a security arm and another security arm, the actuator is a disk, another disk is rotatably attached to the elongated channel, the disk is between the security arm and the another security arm, the security arm is operatively coupled to the disk by a cable having an end pivotally attached to the disk and another end pivotally attached to the security arm, the another security arm is between the disk and the another disk and the another security arm is operatively coupled to the disk by another cable extending from the disk around a portion of a circumference of the another disk to the another security arm and having an end pivotally attached to the disk and another end pivotally attached to the another security arm, and wherein the another plurality of security arms comprises at least a security arm and another security arm, the another actuator is a disk, another disk is rotatably attached to the another elongated channel, the disk is between the security arm and the another security arm, the security arm is operatively coupled to the disk by a cable having an end pivotally attached to the disk and another end pivotally attached to the security arm, the another security arm is between the disk and the another disk and the another security arm is operatively coupled to the disk by the another cable extending from the disk around a portion of a circumference of the another disk to the another security arm and having a end pivotally attached to the disk and another end pivotally attached to the another security arm.

11. The security reinforcement system according to claim 10, wherein the plurality of security arms further comprises still another security arm pivotally attached to the another elongated channel above the security arm and operatively coupled to the security arm by still another cable between the still another security arm and the security arm and yet another security arm pivotally attached to the another elongated channel between the another security arm and the disk and operatively coupled to the another security arm by yet another cable between the yet another security arm and the another security arm, wherein the still another security arm rotates in synchrony with the rotation of the security arm and the yet another security arm rotates in synchrony with the another security arm and wherein the another plurality of security arms further comprises still another security arm pivotally attached to the another elongated channel above the another security arm and operatively coupled to the another security arm by still another cable between the still another security arm and the another security arm and yet another security arm pivotally attached to the another elongated channel between the another security arm and the disk and operatively coupled to the another security arm by yet another cable between the yet another security arm and the another security arm, wherein the still another security arm rotates in synchrony with the rotation of the security arm and the yet another security arm rotates in synchrony with the another security arm.

12. The security reinforcement system according to claim 1, further comprising:

a biasing member coupled to the actuator, the biasing member biasing the actuator in the actuator position and wherein each security arm of the plurality of security arms is operatively coupled to the actuator by a rod; and another biasing member coupled to the another actuator, the another biasing member biasing the another actuator in the another actuator position and wherein each security arm of the another plurality of security arms is operatively coupled to the another actuator by a rod.

13. The security reinforcement system according to claim 12, wherein the actuator is a disk and the biasing member is a coil spring, and wherein the another actuator is another disk and the another biasing member is a coil spring.

* * * * *